US008424615B2

(12) United States Patent
Baumann et al.

(10) Patent No.: US 8,424,615 B2
(45) Date of Patent: Apr. 23, 2013

(54) SYSTEM WITH A HAND-HELD POWER TOOL

(75) Inventors: Otto Baumann, Leinfelden-Echterdingen (DE); Thomas Bernhardt, Aichtal-Groetzingen (DE); Hardy Schmid, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 62 days.

(21) Appl. No.: 12/445,892

(22) PCT Filed: Sep. 7, 2007

(86) PCT No.: PCT/EP2007/059392

§ 371 (c)(1), (2), (4) Date: Apr. 16, 2009

(87) PCT Pub. No.: WO2008/046689

PCT Pub. Date: Apr. 24, 2008

(65) Prior Publication Data

US 2010/0269647 A1 Oct. 28, 2010

(30) Foreign Application Priority Data

Oct. 16, 2006 (DE) ..... 10 2006 048 719

(51) Int. Cl.
*B25G 1/01* (2006.01)

(52) U.S. Cl.
USPC ..... 173/31; 173/217; 173/170; 408/67; 7/167; 362/119

(58) Field of Classification Search ..... 173/217, 173/31, 170; 408/67; 362/119; 7/167
See application file for complete search history.

(56) References Cited

U.S. PATENT DOCUMENTS

| | | | | |
|---|---|---|---|---|
| 2,310,166 | A * | 2/1943 | Way | 362/119 |
| 2,517,882 | A * | 8/1950 | Johnson | 173/46 |
| 3,850,254 | A * | 11/1974 | Hirdes | 173/75 |
| 5,427,002 | A * | 6/1995 | Edman | 81/57 |
| 6,494,590 | B1 * | 12/2002 | Paganini et al. | 362/119 |
| 6,502,949 | B1 | 1/2003 | Horiyama et al. | |
| 6,615,930 | B2 * | 9/2003 | Bongers-Ambrosius et al. | 173/198 |
| 7,017,680 | B2 * | 3/2006 | Arich et al. | 173/198 |
| 7,354,226 | B2 * | 4/2008 | Britz | 408/67 |
| 7,357,526 | B2 * | 4/2008 | Zeiler | 362/119 |

(Continued)

FOREIGN PATENT DOCUMENTS

| | | | |
|---|---|---|---|
| DE | 3516099 | A1 | 11/1986 |
| EP | 1281486 | A1 | 2/2003 |
| EP | 1477272 | A1 | 11/2004 |
| WO | WO 2005039832 | A1 * | 5/2005 |

*Primary Examiner* — Brian D Nash
*Assistant Examiner* — Michelle Lopez
(74) *Attorney, Agent, or Firm* — Maginot, Moore & Beck

(57) ABSTRACT

The invention relates to a system for a hand-held machine tool, particularly a pistol-shaped hand-held machine tool, which includes at least one first auxiliary unit, and a coupling mechanism that is used for coupling the first auxiliary unit and the hand-held machine tool. An example of the invention includes a suction unit as the first auxiliary unit for collecting debris from a hand-held drilling tool. The system also provides for at least one additional auxiliary unit to be coupled to the held-held power tool by the coupling mechanism. An example of the invention includes an illuminating element as an additional auxiliary unit which can be coupled to the tool with the coupling mechanism so as to be interchangeable with the first auxiliary unit.

13 Claims, 4 Drawing Sheets

U.S. PATENT DOCUMENTS 7,425,109 B2 * 9/2008 Simm et al. ..... 408/67
2002/0129949 A1 * 9/2002 Bongers-Ambrosius et al. ..... 173/217
2002/0141836 A1 * 10/2002 Ege et al. ..... 408/67
2004/0231871 A1 * 11/2004 Arich et al. ..... 173/217
2004/0251041 A1 * 12/2004 Grossman ..... 173/217

* cited by examiner

SYSTEM WITH A HAND-HELD POWER TOOL

CROSS-REFERENCE TO RELATED APPLICATION

This application is a 35 USC 371 application of PCT/EP 2007/059392 filed on Sep. 7, 2007.

BACKGROUND OF THE INVENTION

1. Field of the Invention

The invention is based on a system with a hand-held power tool.

2. Description of the Prior Art

There are already known systems with a hand-held power tool, in particular with a pistol-shaped hand-held power tool, and a first auxiliary unit. In addition, the system includes a coupling device that is provided for coupling the first auxiliary unit to the hand-held power tool.

ADVANTAGES AND SUMMARY OF THE INVENTION

The invention is based on a system with a hand-held power tool, in particular with a pistol-shaped hand-held power tool, at least one first auxiliary unit, and a coupling device that is provided for coupling the first auxiliary unit and the hand-held power tool. According to one embodiment, the system includes at least one additional auxiliary unit that is provided for being coupled to the hand-held power tool by means of the coupling device. This makes it possible, in a structurally simple way, to provide an operator of the system with a coupling of various auxiliary units to the hand-held power tool and to advantageously expand an application field for the system. In this case, the various auxiliary units can preferably be interchanged on the hand-held power tool so that an operator can interchange them as needed. In this context, the term "auxiliary unit" is understood to be a unit that can be coupled to the hand-held power tool and has a function in addition to that of the hand-held power tool; an operation of the hand-held power tool is independent of a coupling and/or operation of one of the auxiliary units. The hand-held power tool is in particular comprised of a pistol-shaped hand-held power tool such as a hand-held power tool that drives a tool in a rotating and/or hammering fashion so that the various auxiliary units preferably include a vacuum unit, a light, a laser unit, a wall scanner unit, and/or other units found to be suitable by those skill in the art. The coupling device can be embodied so that at least part of it is integrally joined to the hand-held power tool and/or to one of the auxiliary units. Preferably, the coupling device is provided for coupling all of the auxiliary units included in the system to the hand-held power tool, thus advantageously enabling savings on additional coupling devices.

According to another embodiment, at least part of the coupling device is situated on a housing of the hand-held power tool, thus making it possible to achieve a particularly stable system with the evenest possible weight distribution in the hand-held power tool, particularly with large and/or heavy auxiliary units. In this case, at least part of the coupling device is preferably situated on a region of the housing of the hand-held power tool extending in a working direction on the housing, starting from a main handle of the pistol-shaped hand-held power tool. In this context, the term "working direction" is understood to be a direction that extends from the main handle toward a drilling tool and is also preferably parallel to an axis of the hand-held power tool, such as a drilling axis and/or a drive unit axis. This makes it possible to advantageously avoid having the various auxiliary units interfere with the system operator's ability to see a work piece to be machined and maintains the hand-held power tool's width across the corners.

The coupling device advantageously has at least one interface that is at least partially provided to permit the hand-held power tool to drive and/or input power to at least one of the auxiliary units, thus making it advantageously possible to achieve a low weight and/or a low volume of the system, thus advantageously achieving a high level of operating convenience of the system for an operator. This also advantageously enables savings on additional components, space, complexity of assembly, and costs for a separate drive unit and/or a separate power input for the auxiliary units such as an energy supply cable and/or additional, heavy energy storage units.

According to another embodiment, the coupling device has at least one attaching unit that is provided for attaching the various auxiliary units to the hand-held power tool, thus making it possible to achieve a uniform and also stable attachment for the various auxiliary units to the hand-held power tool.

In another embodiment of the invention, the attaching unit has an insertion unit that is provided to permit various auxiliary units to be inserted into the hand-held power tool, thus making it possible to achieve a structurally simple and in particular, tool-free attachment. With the insertion unit, it is advantageously possible to implement a large support area in a structurally simple fashion so that particularly with large and/or heavy auxiliary units, it is possible to produce a stable attachment to the hand-held power tool, with a balanced distribution of weight. It is also essentially conceivable, however, to provide other options that those skilled in the art find to be suitable for attaching the various auxiliary units to the hand-held power tool, such as a screw connection, a detent connection, a bayonet-mount connection, etc.

According to another embodiment, the insertion unit has at least a first unit, which is equipped with at least one guide element and is provided on a housing of the hand-held power tool, thus making it possible to achieve an advantageously simple insertion of the auxiliary unit during the mounting of an auxiliary unit. The guide element can be composed of a separate component and/or can be formed onto to the housing of the hand-held power tool in a particularly advantageous way, thus enabling savings on additional components. In addition, the guide element is preferably rib-shaped, in particular rail-shaped, and is formed onto the housing.

The insertion unit advantageously has at least one additional unit, which corresponds to the first unit, is equipped with at least one guide element, and is situated on at least one of the auxiliary units, thus making it possible to achieve a form-locked insertion of auxiliary units into the hand-held power tool and therefore making it possible to achieve a particularly stable connection between the various auxiliary units and the hand-held power tool. In this case, the guide element can be composed of a separate component and/or in a particularly advantageous embodiment, can be formed onto the housing of the auxiliary units, thus enabling savings on additional components.

In another embodiment of the invention, the coupling device has a locking unit that makes it possible to achieve a captive attachment of the auxiliary units to the hand-held power tool.

According to another embodiment, the locking unit has at least one detent element that is provided to produce a detent connection between the auxiliary units and the hand-held power tool, thus making it possible to achieve an in particular tool-free and form-locked mounting of auxiliary units onto the hand-held power tool. In another embodiment of the invention found to be suitable by those skill in the art, it is also conceivable to provide a mounting of the various auxiliary units onto the hand-held power tool by means of other form-locked and/or nonpositive, frictional connections. In a particularly advantageous fashion, the detent element includes an actuating element that an operator can actuating without tools, thus making it possible to achieve a simple, and in particular tool-free detachment and tool-free changing of auxiliary units on the hand-held power tool.

The invention also proposes a hand-held power tool for a system, in particular a pistol-shaped hand-held power tool having a coupling device that is provided for coupling various auxiliary units; the coupling device has an insertion unit with at least one guide element. This makes it advantageously possible to achieve a simple insertion of the auxiliary unit during the mounting of an auxiliary unit and during a changing of the various auxiliary units on the hand-held power tool.

According to another embodiment, the insertion unit is situated in a region of the housing that extends starting from a handle in a working direction, thus making it possible to give the operator of the hand-held power tool equipped with an auxiliary unit the ability to see a work piece to be machined.

The coupling device advantageously has at least one detent element, thus making it possible to achieve an in particular tool-free, form-locked mounting of an auxiliary unit onto the hand-held power tool.

BRIEF DESCRIPTION OF THE DRAWINGS

Other advantages ensue from the following description taken in conjunction with the drawings, in which.

DESCRIPTION OF THE PREFERRED EMBODIMENTS

Figure 1:
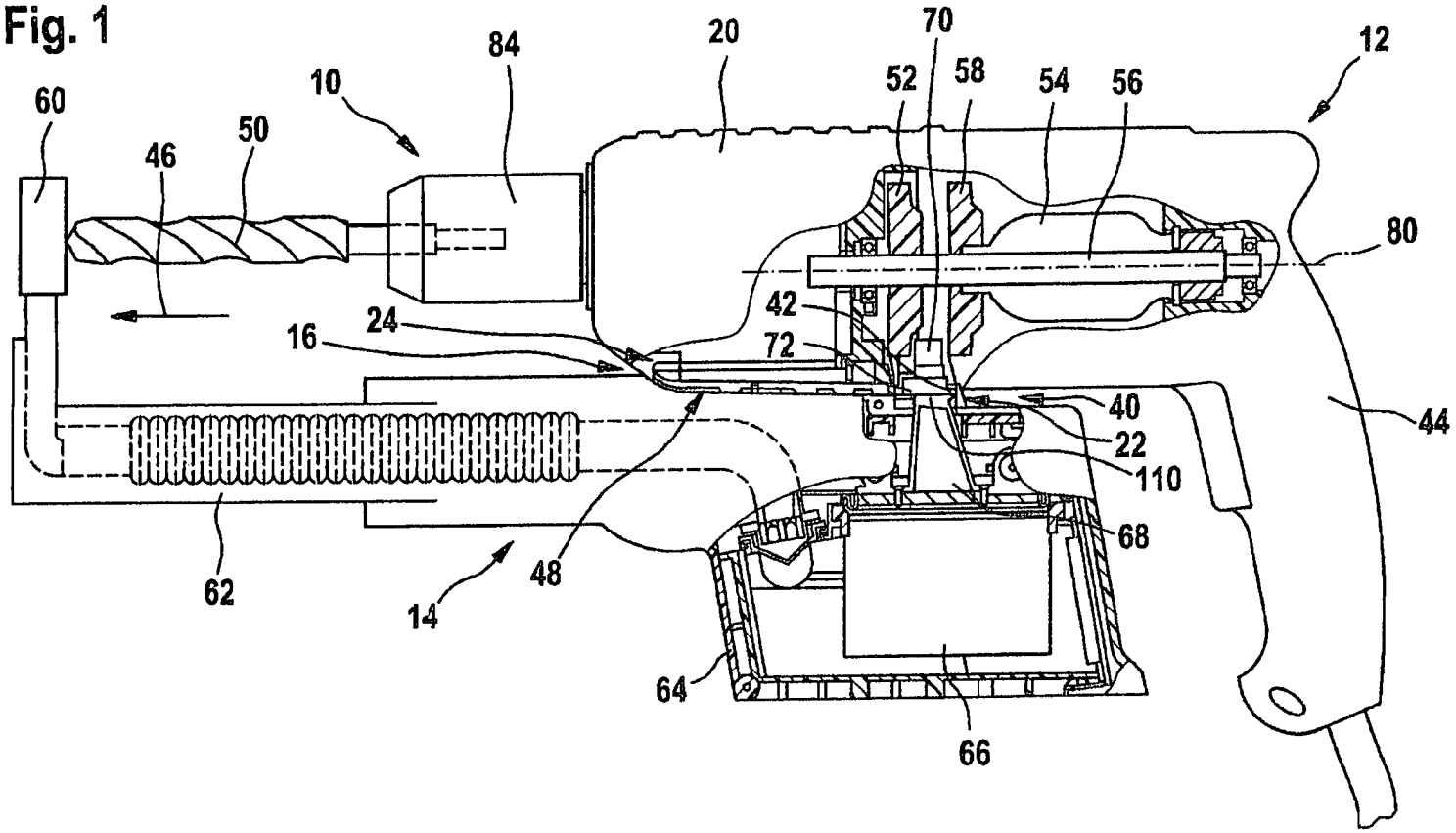
FIG. 1 is a schematic side view of a system according to the invention, with a hand-held power tool and a first auxiliary unit.
Figure 2:
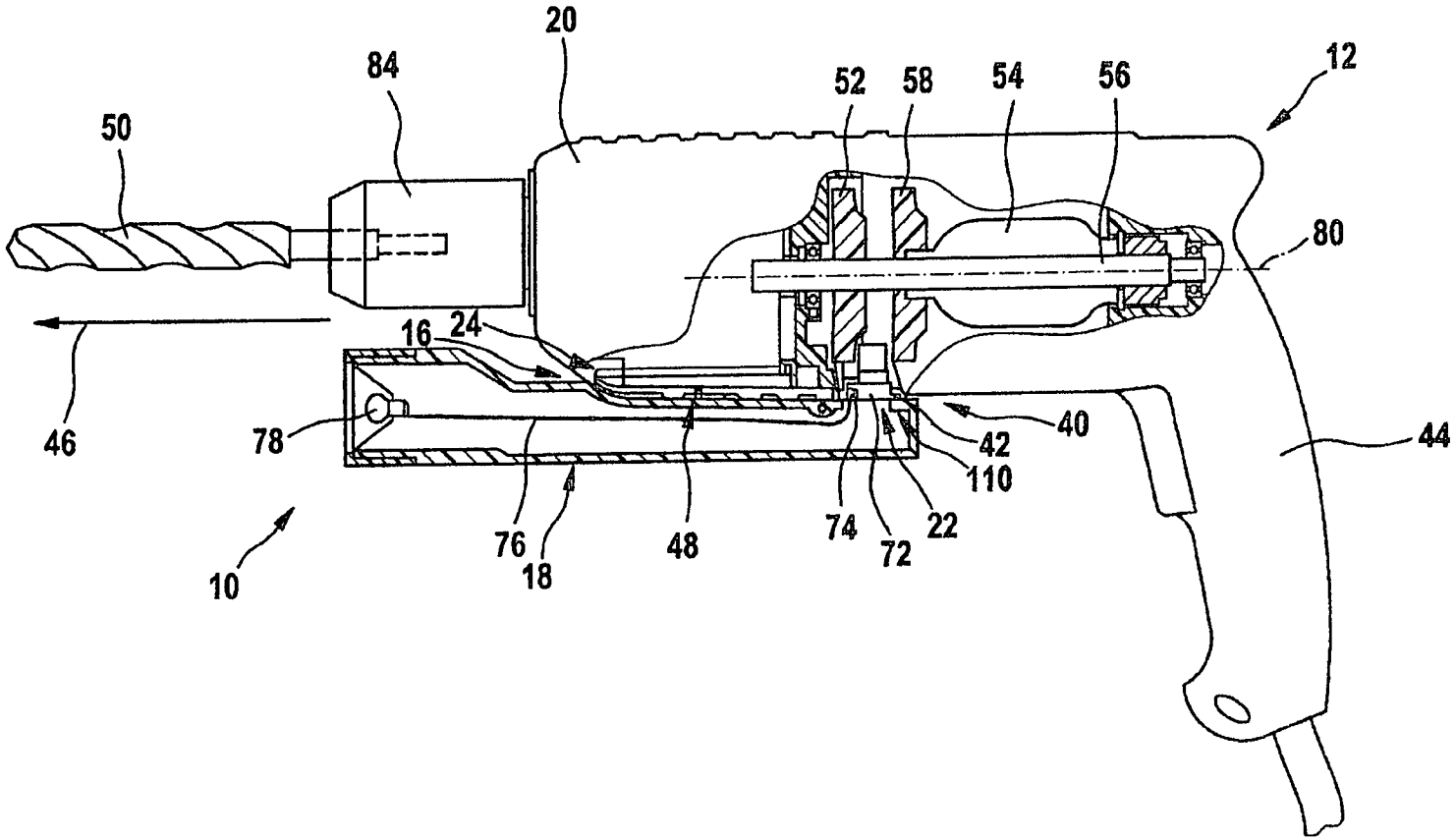
FIG. 2 shows the system from FIG. 1 with an additional auxiliary unit.

FIGS. 1 and 2 each show a system 10 according to the invention, with a pistol-shaped hand-held power tool 12 that has a drilling and/or hammering drive unit, not shown in detail, for a drilling tool 50 and an auxiliary unit 14, 18. In addition, the system 10 has a coupling device 16 that is provided to couple one of the various auxiliary units 14, 18 to the hand-held power tool 12.

The coupling device 16 has an interface 22, an attaching unit 24, and a locking unit 40; the coupling device 16 is split between the hand-held power tool 12 and the auxiliary units 14, 18. In a region 48 of a housing 20, the hand-held power tool 12 is provided with the coupling device 16, which extends from a handle 44 comprised by a main handle, in a working direction 46; the working direction 46 is oriented parallel to a drive unit axis 80 of the hand-held power tool 12 and extends in a direction of the drilling tool 50. In addition, the region 48 and the main handle enclose an angle so that during operation of the hand-held power tool 12 together with one of the auxiliary units 14, 18, an operator is assured unlimited visibility of a work piece to be machined (FIGS. 1 through 3).

The interface 22 of the coupling device 16 is provided to allow the hand-held power tool 12 to drive and/or input power to the individual auxiliary units 14, 18 (FIGS. 1 and 2). The auxiliary unit 14 of the system 10 from FIG. 1, embodied in the form of a vacuum unit, is provided to extract drilling dust and drilling shavings generated during operation of the hand-held power tool 12. An additional fan 52, which is situated in the hand-held power tool 12 and is provided for the auxiliary unit 14, produces aspirating suction in the auxiliary unit 14. In this case, a drive unit 54 of the hand-held power tool 12 transmits a drive torque to a drive shaft 56 that in turn transmits the drive torque to a fan 58, which is provided for cooling the drive unit 54, and to the additional fan 52. In this case, the additional fan 52 produces a suction in the auxiliary unit 14, aspirating air and/or dust into a cylindrical suction head 60 situated around the drilling tool 50 (FIG. 1). Inside the auxiliary unit 14, the aspirated drilling dust travels via a variable-length suction arm 62 into a suction unit 64. The suction unit 64 includes the removable filter 66 in which the aspirated drilling dust and drilling shavings are separated from the aspirated air. The purified air is conveyed via a suction conduit 68 of the auxiliary unit 14 to the interface 22 and then via a suction conduit 70 to a coupling means 72 of the interface 22, to the hand-held power tool 12, and to the additional fan 52 and escapes there through ventilation openings, not shown in detail, provided in the hand-held power tool 12.

In FIG. 2, the auxiliary unit 18 embodied in the form of a lamp is supplied with electrical power via the interface 22. For this purpose, the interface 22 on the coupling means 72 has an electric contact element 74 on the hand-held power tool 12, which serves to produce an electrical contact between the hand-held power tool 12 and an electric contact element, not shown in detail, of the auxiliary unit 18. An internal electric line 76 of the auxiliary unit 18 supplies the electrical energy from the interface 22 to an illuminating element 78 of the auxiliary unit 18, which, during operation of the hand-held power tool 12, lights a region of a work piece to be machined. In another embodiment of the invention, it is essentially also easily conceivable to provide other auxiliary units found to be suitable by those skilled in the art, such as an auxiliary unit embodied in the form of a wall scanner, an auxiliary unit embodied in the form of a laser, etc.

Figure 3:
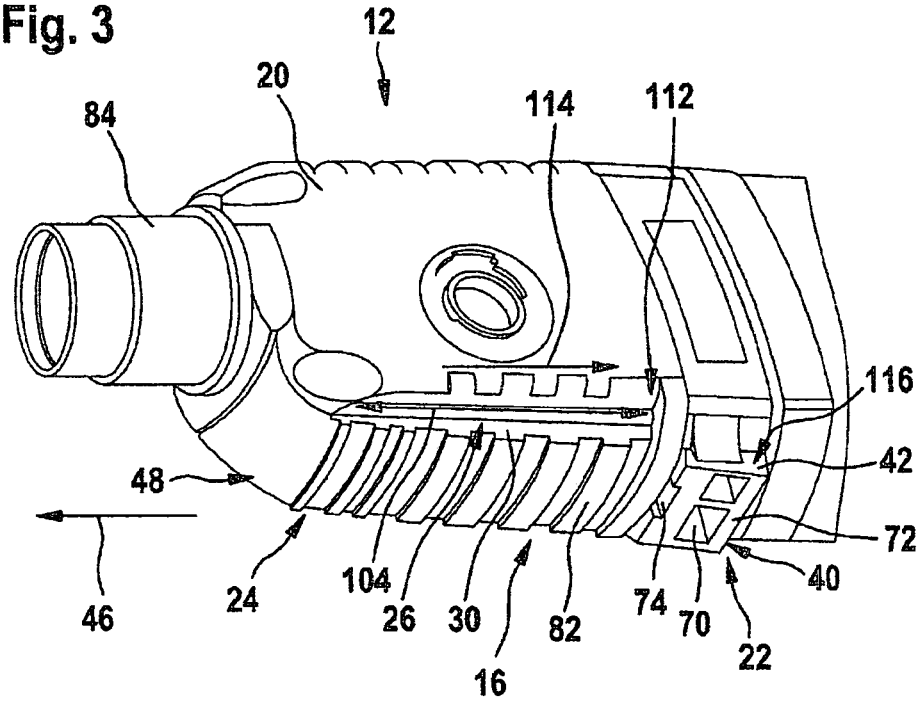
FIG. 3 is a perspective side view of part of the hand-held power tool from FIG. 1, with a coupling device.
Figure 4:
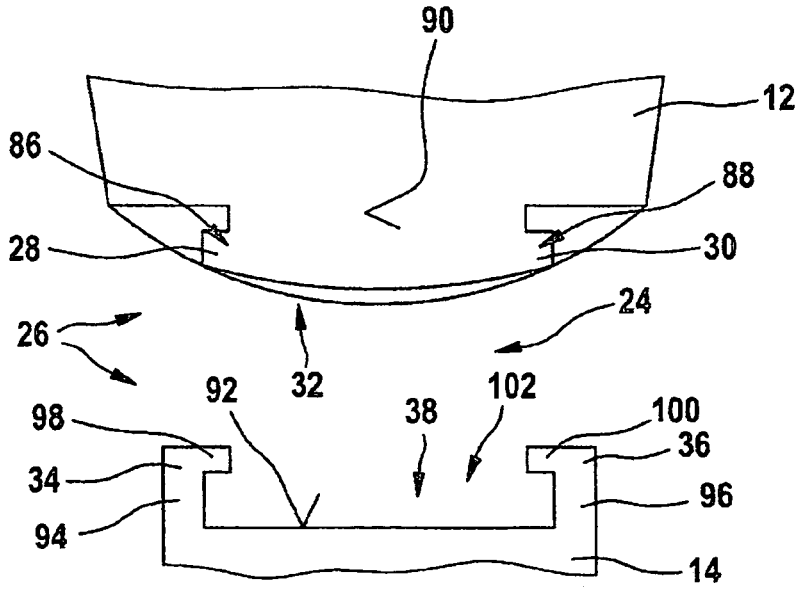
FIG. 4 is a front view of a subregion of the system from FIG. 1 in the region of the insertion unit.
Figure 5:
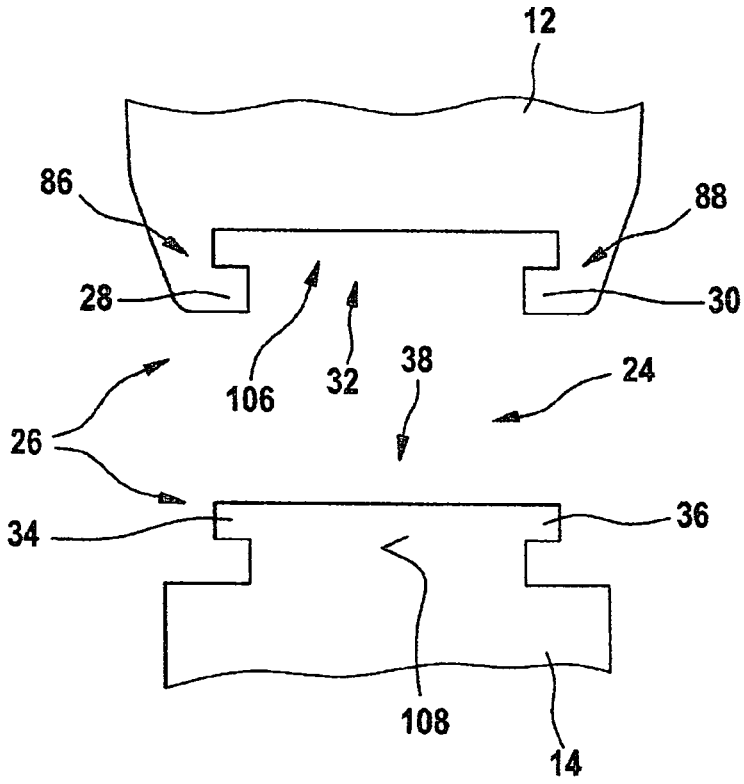
FIG. 5 is a front view of a subregion of the system from FIG. 1 in the region of an alternative insertion unit.

The attaching unit 24 of the coupling device 16 is provided for attaching various auxiliary units 14, 18 to the hand-held power tool 12 and has an insertion unit 26 (FIGS. 3 through 5). For insertion of the various auxiliary units 14, 18 into the hand-held power tool 12, the insertion unit 26 has two units 32, 38 that each have two guide elements 28, 30, 34, 36. A first of the two units 32 is formed onto the hand-held power tool 12 in the region 48 of the housing 20 (FIG. 3); the region 48 extends from the handle 44 of the hand-held power tool 12 in the working direction 46 and is constituted by an underside 82 of the housing 20. In addition, the region 48 is situated between the interface 22 of the coupling device 16 and a clamping fitting 84 of the hand-held power tool 12 (FIG. 3). The guide elements 28, 30 of the first unit 32 are each formed in a rib shape onto a respective edge region 86, 88 of the underside 82 of the housing 20 extending parallel to the working direction 46; the rib-shaped guide elements 28, 30 are also oriented parallel to the underside 82. In addition, the two rib-shaped guide elements 28, 30 extend in opposite respective directions from the housing 20 of the hand-held power tool 12 so that the first unit 32 has a T-shaped cross-sectional area 90 (FIG. 4).

The other unit 38 corresponding to the first unit 32 is situated on the various auxiliary units 14, 18. The two guide elements of 34, 36 of the unit 38 are each integrally formed onto a side 92 of the auxiliary unit 14, 18 oriented toward the hand-held power tool 12; the guide elements 34, 36 each have a respective subregion 94, 96 oriented perpendicular to the side 92 of the auxiliary unit 14, 18. The perpendicularly oriented subregions 94, 96 of the guide elements 34, 36 are each adjoined by a respective rib-shaped subregion 98, 100 oriented perpendicular to them; the rib-shaped subregions 98, 100 each extend in a direction toward the other guide element 34, 36 of the auxiliary unit 14, 18 so that the auxiliary unit 14, 18 or the unit 38 has a T-shaped receiving region 102 (FIG. 4). In order to achieve a maximum hold of the auxiliary units 14, 18 on the hand-held power tool 12 and the largest possible support area together with a uniform weight distribution on the hand-held power tool 12, a length of the two guide elements 34, 36 of the unit 38 in the mounted position corresponds to a length 104 of the two guide elements 28, 30 of the first unit 32 on the hand-held power tool 12 (FIG. 3).

FIG. 5 shows an insertion unit 26 of the system 10 that is alternative to the one shown in FIGS. 1 through 4. In this case, the first unit 32 of the insertion unit 26, together with the guide elements 28, 30 on the hand-held power tool 12, has a T-shaped receiving region 106 for coupling the auxiliary units 14, 18 to the hand-held power tool 12. The other unit 38 corresponding to the first unit 32, together with the guide elements 34, 36 on the auxiliary unit 14, 18, includes a T-shaped cross-sectional area 108 that is inserted into the T-shaped receiving region 106 of the hand-held power tool 12. In another embodiment of the invention, it is also conceivable to embody the attaching unit 24 of the coupling device 16 with a dovetail-shaped receiving region and to embody one of the two units 32, 38 with a dovetail-shaped cross-sectional area and/or to provide them with other designs found to be suitable by those skilled in the art.

In order to lock the auxiliary units 14, 18 in place once they have been inserted into the hand-held power tool 12, the locking unit 40 is situated in the region of the interface 22. The locking unit 40 has a detent element 42, which is situated on the coupling means 72 on the hand-held power tool 12, and a corresponding detent element, not shown in greater detail, which is situated on the respective auxiliary units. For this purpose, the auxiliary units 14, 18 and the guide elements 34, 36 of the auxiliary units 14, 18 are inserted into the insertion unit 26 on the hand-held power tool 12 until they reach an interface end 112 of the insertion unit 26 and the coupling means 72 of the hand-held power tool 12 comes into contact with a corresponding coupling means 110 of the auxiliary units 14, 18. An edge region 116 of the coupling means 72 oriented toward the interface 22 and pointing in an insertion direction 114 on the hand-held power tool 12 is provided with the detent element 42, which extends in rib fashion in the insertion direction 114 on the edge region 116 of the coupling means 72. When one of the auxiliary units 14, 18 is inserted all the way into the unit 32 of the hand-held power tool 12, the two detent elements 42 produce a detent connection between the hand-held power tool 12 and the auxiliary unit 14, 18 so that the auxiliary unit 14, 18 is mounted onto the hand-held power tool 12 in a stable, secure fashion. The detent connection between the auxiliary units 14, 18 and the hand-held power tool 12 is released by means of an actuating element, not shown in detail, on the auxiliary units 14, 18.

The foregoing relates to the preferred exemplary embodiments of the invention, it being understood that other variants and embodiments thereof are possible within the spirit and scope of the invention, the latter being defined by the appended claims.

The invention claimed is:

1. A hand-held power tool system, comprising:

a vacuum unit;

a pistol-shaped, hand-held power tool including a housing having first and second ends, said housing having a handle attached to said first end, said housing includes a drive unit, a drive shaft, a fan connected to the drive shaft, and a suction inlet fluidically connected to a suction passageway therethrough, wherein, during use, the drive unit transmits torque to the drive shaft which, in turn, transmits torque to the fan which is capable of producing suction in the vacuum unit and conveys air through the suction passageway through the housing;

said power tool having a working direction extending from the handle toward the second end of the housing;

a coupling device located on the housing and extending along the housing in the working direction, said coupling device slidably coupling in the working direction the vacuum unit directly to the hand-held power tool, said coupling device including an interface and an attaching unit, said interface, during use, allowing the hand-held power tool to either drive, or input power to, the vacuum unit that is secured to the tool by the coupling device;

said vacuum unit having a suction conduit, said vacuum unit being attached to the hand-held power tool by means of said coupling unit such that said suction conduit is connected to said vacuum inlet, whereby as the fan produces suction in the vacuum unit, air travels through the suction conduit of the vacuum unit and the suction passageway of the hand-held power tool;

at least one auxiliary unit that is provided to be coupled directly to the hand-held power tool for use separately from, and in place of, the vacuum unit by means of the coupling device; and said interface having an electrical contact element which serves to produce an electrical connection between the power tool and an electrical contact element of one of said vacuum unit or said at least one auxiliary unit.

2. The system as recited in claim 1, wherein the coupling device has at least one attaching unit that is provided for attaching various auxiliary units to the hand-held power tool.

3. The system as recited in claim 2, wherein the attaching unit has an insertion unit that is provided to permit various auxiliary units to be inserted into the hand-held power tool.

4. The system as recited in claim 3, wherein the insertion unit has at least one first unit, which has at least one guide element and is situated on a housing of the hand-held power tool.

5. The system as recited in claim 4, wherein the insertion unit has at least one additional unit, which corresponds to the first unit, has at least one guide element, and is situated on at least one of the vacuum unit and the at least one auxiliary unit.

6. The system as recited in claim 5, wherein the coupling device has a locking unit.

7. The system as recited in claim 1, wherein the coupling device has a locking unit.

8. The system as recited in claim 7, wherein the locking unit has at least one detent element that is provided for producing a detent connection between the vacuum unit or the at least one auxiliary unit and the hand-held power tool.

9. The hand-held power tool as recited in claim 1, wherein the coupling device has at least one detent element.

10. The system as recited in claim 1, wherein the system does not include a battery or a battery pack.

11. The system as recited in claim 1, further including a second fan for cooling the drive unit.

12. The system as recited in claim 1, wherein the at least one auxiliary unit is a lamp which is supplied with electrical power via the electric contact element on the interface.

13. The system as recited in claim 12, wherein the lamp includes an internal electric line which supplies electrical energy from the interface to an illuminating element.

* * * * *